US008492059B2

(12) United States Patent
Hashiba et al.

(10) Patent No.: US 8,492,059 B2
(45) Date of Patent: Jul. 23, 2013

(54) ELECTROPHOTOGRAPHIC PHOTORECEPTOR, PROCESS CARTRIDGE AND IMAGE FORMING APPARATUS

(75) Inventors: Shigeto Hashiba, Kanagawa (JP); Kazuhiro Koseki, Kanagawa (JP); Kaori Iemura, Tokyo (JP); Kenta Ide, Kanagawa (JP); Satoya Sugiura, Kanagawa (JP); Fuyuki Kano, Kanagawa (JP); Kazuyuki Nakamura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 428 days.

(21) Appl. No.: 12/582,280

(22) Filed: Oct. 20, 2009

(65) Prior Publication Data

US 2010/0196810 A1 Aug. 5, 2010

(30) Foreign Application Priority Data

Feb. 4, 2009 (JP) ..... 2009-023982

(51) Int. Cl.
*G03G 5/147* (2006.01)

(52) U.S. Cl.
USPC ..... 430/67; 430/66; 399/159

(58) Field of Classification Search
USPC ..... 430/66, 67, 58.05; 399/159
See application file for complete search history.

(56) References Cited

U.S. PATENT DOCUMENTS

| | | | | |
|---|---|---|---|---|
| 4,792,507 | A | 12/1988 | Yoshihara et al. | |
| 6,204,213 | B1 * | 3/2001 | Mehrotra et al. | 501/95.3 |
| 6,706,457 | B2 * | 3/2004 | Koumura | 430/108.3 |
| 7,166,396 | B2 * | 1/2007 | Qi et al. | 430/58.65 |
| 7,232,633 | B2 * | 6/2007 | Qi et al. | 430/58.8 |
| 2002/0068231 | A1 * | 6/2002 | Uesugi et al. | 430/66 |
| 2005/0031980 | A1 * | 2/2005 | Inoue et al. | 430/108.22 |
| 2005/0203214 | A1 * | 9/2005 | Amano et al. | 523/212 |
| 2008/0131802 | A1 * | 6/2008 | Mizutani et al. | 430/109.4 |
| 2008/0199795 | A1 * | 8/2008 | Ogaki et al. | 430/66 |
| 2009/0226208 | A1 * | 9/2009 | Nukada et al. | 399/111 |

FOREIGN PATENT DOCUMENTS

| | | |
|---|---|---|
| JP | A-63-221355 | 9/1988 |
| JP | A-6-250460 | 9/1994 |
| JP | A-8-254850 | 10/1996 |
| JP | B2-3859086 | 12/2006 |

OTHER PUBLICATIONS

Diamond et al.,ed., Handbook of Imaging Materials, second edition, Marcel Dekker, Inc., NY (2002), pp. 150-151.*

* cited by examiner

*Primary Examiner* — Janis L Dote
(74) *Attorney, Agent, or Firm* — Oliff & Berridge, PLC

(57) ABSTRACT

An electrophotographic photoreceptor, includes: a conductive support; and a photosensitive layer provided on or above the conductive support, the photosensitive layer including an outermost surface layer at the farthest location from the conductive support, wherein the outermost surface layer contains: coated insulating inorganic particles obtained by subjecting insulating inorganic particles having a specific surface area of not more than about 300 $m^2/g$ to a coating treatment with an aromatic functional group-containing compound; and fluorine-containing organic particles.

14 Claims, 9 Drawing Sheets

ELECTROPHOTOGRAPHIC PHOTORECEPTOR, PROCESS CARTRIDGE AND IMAGE FORMING APPARATUS

CROSS-REFERENCE TO RELATED APPLICATION

This application is based on and claims priority under 35 USC 119 from Japanese Patent Application No. 2009-023982 filed Feb. 4, 2009.

BACKGROUND

1. Technical Field

The present invention relates to an electrophotographic photoreceptor, a process cartridge and an image forming apparatus.

2. Related Art

An image forming method of an electrophotographic system has been being utilized in image forming apparatuses such copying machines and laser beam printers because high-quality printing may be achieved at a high speed. As an electrophotographic photoreceptor (hereinafter sometimes referred to simply as "photoreceptor") which is useful in such an image forming apparatus, a photoreceptor using an organic photoconductive material which is inexpensive and excellent in manufacturing properties and disposal properties as compared with an inorganic photoconductive material has been the mainstream. Above all, a function-separated photoreceptor in which a charge generating layer for generating a charge upon exposure and a charge transporting layer for transporting a charge are stacked is excellent in view of electrophotographic characteristics and is put into practical use. In recent years, a demand for a high image quality is further increased, and the image formation with a high quality such that a fine line, e.g., a 1-dot line may be sufficiently reproduced and that a halftone image can be reproduced without unevenness is required.

Meanwhile, the photoreceptor using an organic photoconductive material is in general inferior to the photoreceptor using an inorganic photoconductive material in the mechanical strength, is liable to generate a scratch or a wear due to a mechanical external force by a cleaning blade, a developing brush, a copying paper or the like and is short in life. Also, there may be the case where in a system using a contact charge system which has recently been used from the viewpoint of an environmental load, a wear of the photoreceptor largely increases as compared with a non-contact charge system by a corotron. In this way, insufficient durability of a photoreceptor causes a lowering of an image density due to a reduction of sensitivity, generation of fog on an image due to a lowering of a charge potential and the like.

Up to date, there has been investigated a method for enhancing durability of a photosensitive layer.

SUMMARY

According to an aspect of the invention, there is provided an electrophotographic photoreceptor, including: a conductive support; and a photosensitive layer provided on or above the conductive support, the photosensitive layer including an outermost surface layer at the farthest location from the conductive support, wherein the outermost surface layer contains: coated insulating inorganic particles obtained by subjecting insulating inorganic particles having a specific surface area of not more than about 300 $m^2/g$ to a coating treatment with an aromatic functional group-containing compound; and fluorine-containing organic particles.

BRIEF DESCRIPTION OF THE DRAWINGS

Exemplary embodiments of the present invention will be described in detail based on the following figures, wherein.

DETAILED DESCRIPTION

Figure 1:
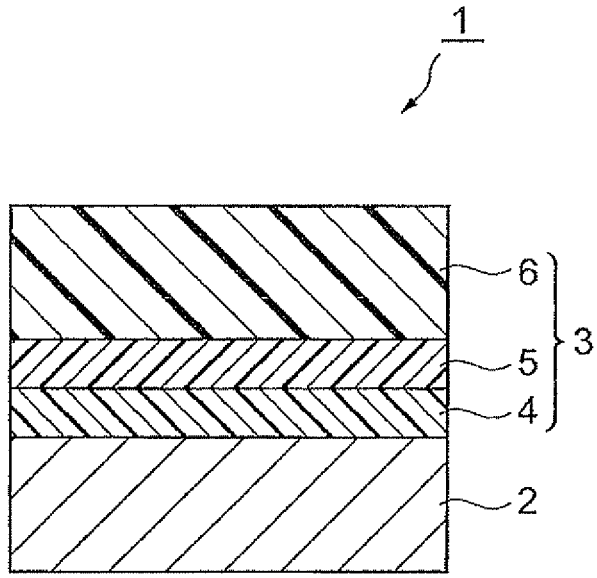
FIG. 1 is a schematic sectional view showing an electrophotographic photoreceptor according to an exemplary embodiment.

Preferred exemplary embodiments of the invention are hereunder described in detail while referring to the accompanying drawings as the need arises. In the drawings, the same or equivalent elements are given the same symbols, and overlapping descriptions are omitted. Also, unless otherwise indicated, positional relationships such as up and down, left and right are based on the positional relationships shown in the drawings. Furthermore, it should not be construed that dimensional ratios in the drawings are limited to illustrated ratios.

(Electrophotographic Photoreceptor)

FIG. 1 is a schematic sectional view showing an electrophotographic photoreceptor according to an exemplary embodiment. An electrophotographic photoreceptor 1 shown in FIG. 1 is configured to include a conductive support 2 and a photosensitive layer 3. The photosensitive layer 3 has a structure in which a undercoat layer 4, a charge generating layer 5 and a charge transporting layer 6 are stacked in this order on the conductive support 2. In the eleetrophotographic photoreceptor 1 shown in FIG. 1, the charge transporting layer 6 provided at the farthest location from the conductive support 2 of the photosensitive layer 3 is an outermost surface layer containing a coated insulating inorganic particle obtained by subjecting an insulating inorganic particle having a specific surface area of not more than 300 $m^2/g$ or not more than about 300 $m^2/g$ to a coating treatment with an aromatic functional group-containing compound and a fluorine-containing organic particle. According to this, it is possible to form a high-quality image having excellent durability, and capable of sufficiently reproducing a fine line and a halftone.

Figure 2:
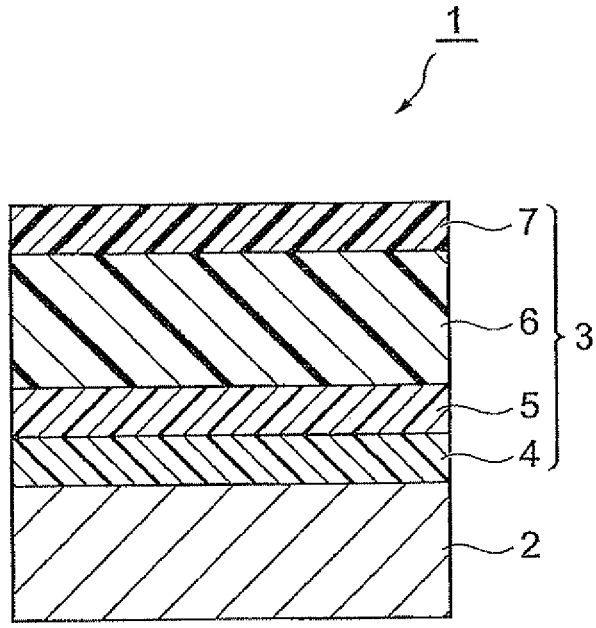
FIG. 2 is a schematic sectional view showing an electrophotographic photoreceptor according to another exemplary embodiment.
Figure 3:
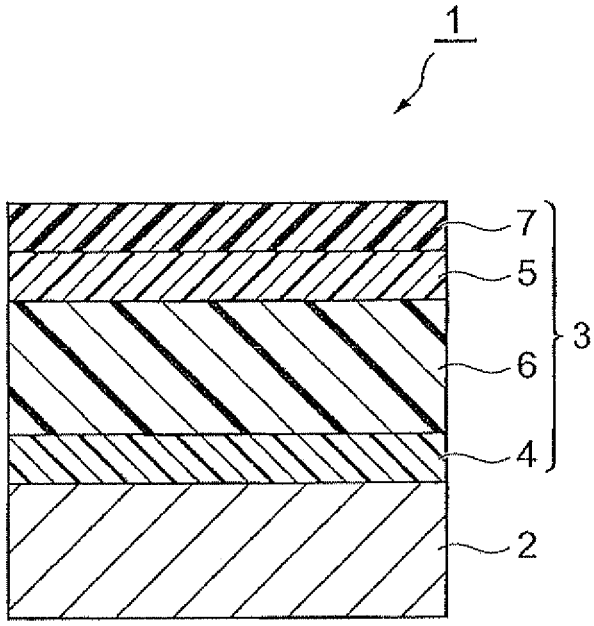
FIG. 3 is a schematic sectional view showing an electrophotographic photoreceptor according to other exemplary embodiment.

Each of FIGS. 2 to 5 is a schematic sectional view showing an electrophotographic photoreceptor according to other exemplary embodiment. Each of electrophotographic photoreceptors shown in FIGS. 2 and 3 is provided with the photosensitive layer 3 in which similar to that of the electrophotographic photoreceptor shown in FIG. 1, functions are separated between the charge generating layer 5 and the charge transporting layer 6. Also, in each of electrophotographic photoreceptors shown in FIGS. 4 and 5, a charge generating material and a charge transporting material are incorporated in the same layer (single-layered photosensitive layer 8).

The electrophotographic photoreceptor 1 shown in FIG. 2 is configured to include the conductive support 2 and the photosensitive layer 3. The photosensitive layer 3 has a structure in which the undercoat layer 4, the charge generating layer 5, the charge transporting layer 6 and a protective layer 7 are stacked in this order on the conductive support 2. In the electrophotographic photoreceptor 1 shown in FIG. 2, the protective layer 7 is an outermost surface layer containing the coated insulating inorganic particle according to the invention and the fluorine-containing organic particle.

The electrophotographic photoreceptor 1 shown in FIG. 3 is configured to include the conductive support 2 and the photosensitive layer 3. The photosensitive layer 3 has a structure in which the undercoat layer 4, the charge transporting layer 6, the charge generating layer 5 and the protective layer 7 are stacked in this order on the conductive support 2. In the electrophotographic photoreceptor 1 shown in FIG. 3, the protective layer 7 is an outermost surface layer containing the coated insulating inorganic particle according to the invention and the fluorine-containing organic particle.

Figure 4:
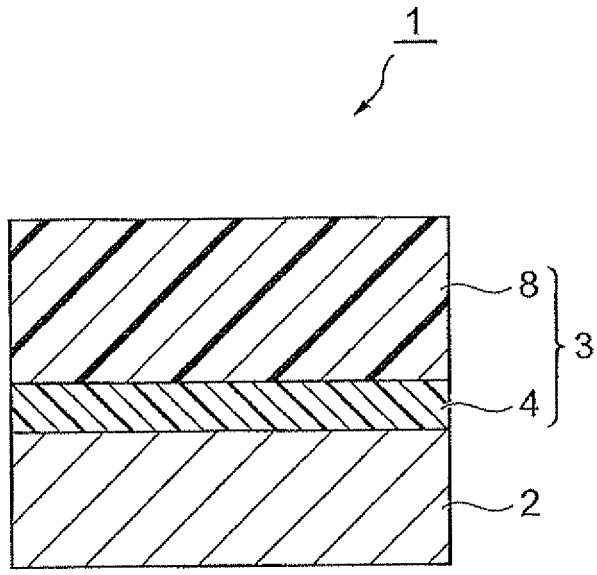
FIG. 4 is a schematic sectional view showing an electrophotographic photoreceptor according to other exemplary embodiment.

The electrophotographic photoreceptor 1 shown in FIG. 4 is configured to include the conductive support 2 and the photosensitive layer 3. The photosensitive layer 3 has a structure in which the undercoat layer 4 and the single-layered photosensitive layer 8 are stacked in this order on the conductive support 2. In the electrophotographic photoreceptor 1 shown in FIG. 4, the single-layered photosensitive layer 8 is an outermost surface layer containing the coated insulating inorganic particle according to the invention and the fluorine-containing organic particle.

Figure 5:
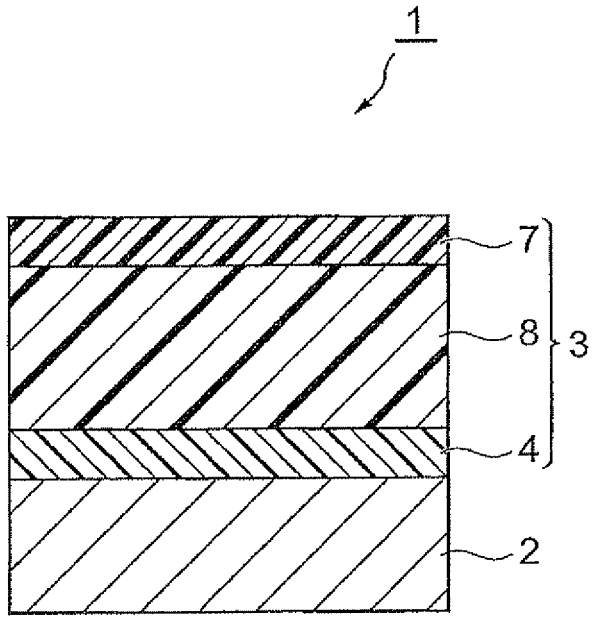
FIG. 5 is a schematic sectional view showing an electrophotographic photoreceptor according to other exemplary embodiment.

The electrophotographic photoreceptor 1 shown in FIG. 5 is configured to include the conductive support 2 and the photosensitive layer 3. The photosensitive layer 3 has a structure in which the undercoat layer 4, the single-layered photosensitive layer 8 and the protective layer 7 are stacked in this order on the conductive support 2. In the electrophotographic photoreceptor 1 shown in FIG. 5, the protective layer 7 is an outermost surface layer containing the coated insulating inorganic particle and the fluorine-containing organic particle according to the invention.

As described previously, the photosensitive layer with which the electrophotographic receptor according to the present exemplary embodiment is provided may be any of a single-layered photosensitive layer containing a charge generating material and a charge transporting material in the same layer or a function-separated photosensitive layer in which a charge generating material-containing layer (charge generating layer) and a charge transporting material-containing layer (charge transporting layer) are individually provided. In case of a function-separated photosensitive layer, as to the lamination order, any of the charge generating layer or the charge transporting layer may be an upper layer. In case of a function-separated photosensitive layer, the function separation is carried out such that each of the layers may be satisfied with either one of the functions, and higher functions are realized as compared with those in the single-layered photosensitive layer.

The respective elements are hereunder described while referring to the electrophotographic photoreceptor 1 shown in FIG. 1 as a representative example.

The conductive support 2 is not particularly limited so far as it is a material which has hitherto been used. Examples thereof include metals such as aluminum, nickel, chromium and stainless steel; plastic films provided with a thin film made of aluminum, titanium, nickel, chromium, stainless steel, gold, vanadium, tin oxide, indium oxide, ITO, etc.; and papers or plastic films coated or impregnated with a conductivity imparting agent.

A shape of the conductive support 2 is not particularly limited and may be, for example, a drum form, a sheet form or a plate form. In the case where the conductive support 2 is formed of a metal pipe, the surface may be a raw pipe, or a treatment such as mirror cutting, etching, anodic oxidation, rough cutting, centerless grinding, sandblasting and wet horning may be carried out in advance.

The undercoat layer 4 is a layer which is provided on the conductive support 2 as the need arises for the purposes of preventing light reflection on the surface of the conductive support 2, preventing incorporation of an unnecessary carrier from the conductive support 2 into the photosensitive layer 3 and the like.

The undercoat layer 4 may be made of a binding resin alone, or may be a layer having a structure in which a powder for undercoat layer, such as powders of a metal (for example, aluminum, copper, nickel, silver, etc.); powders of a conductive metal oxide (for example, antimony oxide, indium oxide, tin oxide, zinc oxide, etc.); and powders of a conductive material (for example, carbon fiber, carbon black, a graphite powder, etc.), is dispersed in a binding resin as the need arises. The powder for undercoat layer may be used singly or in admixture of two or more kinds thereof. Furthermore, the powder for undercoat layer may be subjected to a surface treatment with a coupling agent. In the powder for undercoat layer having been subjected to such a treatment, its powder resistivity is controlled.

Examples of the binding resin which constitutes the undercoat layer 4 include polymer resin compounds such as acetal resins (for example, polyvinyl butyral, etc.), polyvinyl alcohol resins, casein, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol resins, phenol-formaldehyde resins, melamine resins and urethane resins; charge transporting group-containing charge transporting resins; and conductive resins such as polyanilines. Of these, resins which are insoluble in a coating solvent in forming an upper layer as described later (the charge generating layer 5 in the present exemplary embodiment) are preferable. From these viewpoints, phenol resins, phenol-formaldehyde resins, melamine resins, urethane resins, epoxy resins and the like are preferable.

A ratio between the powder for undercoat layer and the binding resin in the undercoat layer 4 is not particularly limited, but it may be arbitrarily set up within the range where desired electrophotographic photoreceptor characteristics are obtainable.

The undercoat layer 4 may be formed by, for example, coating a coating solution for forming an undercoat layer obtained by mixing a powder for undercoat layer and a binding resin with a prescribed solvent on the conductive support 2 and then drying it.

Examples of the solvent which is used in the coating solution for forming an undercoat layer include organic solvents such as aromatic hydrocarbon based solvents (for example, toluene, chlorobenzene, etc.); aliphatic alcohol based solvents (for example, methanol, ethanol, n-propanol, isopropanol, n-butanol, etc.); ketone based solvents (for example, acetone, cyclohexanone, 2-butanone, etc.); halogenated aliphatic hydrocarbon based solvents (for example, methylene chloride, chloroform, ethylene chloride, etc.); cyclic or linear ether based solvents (for example, tetrahydrofuran, dioxane, ethylene glycol, diethyl ether, etc.); and ester based solvents (for example, methyl acetate, ethyl acetate, n-butyl acetate, etc.). These solvents may be used singly or in combinations with two or more kinds thereof. The solvent which is used is preferably a solvent which is soluble in the binding resin. In the case where a combination of two or more kinds of solvents is used, its mixed solvent may be soluble in the binding resin.

Examples of a method for dispersing the powder for undercoat layer in the coating solution for forming a undercoat layer include methods using a media dispersing machine (for example, a ball mill, a vibrating ball mill, an attritor, a sand mill, a horizontal sand mill, etc.) and methods using a media-less dispersing machine (for example, stirring, an ultrasonic dispersing machine, a roll mill, a high-pressure homogenizer, etc.). Furthermore, as the high-pressure homogenizer, a collision system for dispersing a dispersion in a high-pressure state through liquid-liquid collision or liquid-wall collision, a penetration system for dispersing a dispersion in a high-pressure state through penetration into a fine channel may be adopted.

Examples of a method for coating the coating solution for forming a undercoat layer on the conductive support 2 include a dip coating method, a push-up coating method, a wire bar coating method, a spray coating method, a blade coating method, a knife coating method and a curtain coating method.

A thickness of the undercoat layer 4 is preferably 0.1 μm or more and not more than 50 μm. When the thickness of the undercoat layer 4 is less than 0.1 μm, there may be the case where irregularities such as substrate defect may not be hidden, thereby causing image defect. When it exceeds 50 μm, there is a concern that an obstruction in electric characteristics is generated in view of an increase of a trap in the film. In order to bear a sufficient function to prevent pinhole leakage on the undercoat layer 4 from occurring, the thickness of the undercoat layer 4 is more preferably 15 μm or more, and further preferably 20 μm or more and not more than 50 μm. The undercoat layer 4 may further contain a resin particle for the purpose of regulating a surface roughness. Examples of the resin particle include a silicone resin particle and a crosslinking type PMMA resin particle. Also, the surface of the formed undercoat layer 4 may be subjected to polishing for regulating a surface roughness. Examples of a polishing method include buffing, sandblasting, wet horning and grinding.

The charge generating layer 5 has a structure in which a charge generating material is dispersed in an appropriate binding resin. Examples of the charge generating material include phthalocyanine pigments such as metal-free phthalocyanine, chlorogallium phthalocyanine, hydroxygallium phthalocyanine, dieblorotin phthalocyanine and titanyl phthalocyanine. Of these, a chlorogallium phthalocyanine crystal having strong diffraction peaks of at least 7.4°, 16.6°, 25.5° and 28.3° at Bragg angles (2θ±0.2°) on CuKα characteristic X-rays; a metal-free phthalocyanine crystal having strong diffraction peaks of at least 7.7°, 9.3°, 16.9°, 17.5°, 22.4° and 28.8° at Bragg angles (2θ±0.2°) on CuKα characteristic X-rays; a hydroxygallium phthalocyanine crystal having strong diffraction peaks of at least 7.5°, 9.9°, 12.5°, 16.3°, 18.6°, 25.1° and 28.3° at Bragg angles (2θ±0.2°) on CuKα characteristic X-rays; and a titanyl phthalocyanine crystal having strong diffraction peaks of at least 9.6°, 24.1° and 27.2° at Bragg angles (2θ±0.2) on CuKα characteristic X-rays are preferable. Examples of other charge generating materials than those described above include quinone pigments, perylene pigments, indigo pigments, bisbenzimidazole pigments, anthrone pigments and quinacridone pigments. The foregoing charge generating materials may be used singly or in combinations of two or more kinds thereof.

Examples of the binding resin in the charge generating layer 5 include polycarbonate resins of a bisphenol A type or a bisphenol Z type or the like, acrylic resins, methacrylic resins, polyarylate resins, polyester resins, polyvinyl chloride resins, polystyrene resins, acrylonitrile-styrene copolymer resins, acrylonitrile-butadiene copolymer resins, polyvinyl acetate resins, polyvinyl formal resins, polysulfone resins, styrene-butadiene copolymer resins, vinylidene chloride-acrylonitrile copolymer resins, vinyl chloride-vinyl acetate-maleic anhydride resins, silicone resins, phenol-formaldehyde resins, polyacrylamide resins, polyamide resins and poly-N-vinylcarbazole resins. These binding resins may be used singly or in combinations of two or more kinds thereof.

A blending ratio (weight ratio) between the charge generating material and the binding resin in the charge generating layer 5 is preferably in the range of from 10/1 to 1/10.

The charge generating layer 5 may be formed by, for example, coating a coating solution for forming a charge generating layer obtained by mixing a charge generating material and a binding resin with a prescribed solvent on the undercoat layer 4 and then drying it.

Examples of the solvent which is used in the coating solution for forming a charge generating layer include organic solvents such as aromatic hydrocarbon based solvents (for example, toluene; chlorobenzene, etc.); aliphatic alcohol based solvents (for example, methanol, ethanol, n-propanol, isopropanol, n-butanol, etc.); ketone based solvents (for example, acetone, cyclohexanone, 2-butanone, etc.); halogenated aliphatic hydrocarbon based solvents (for example, methylene chloride, chloroform, ethylene chloride, etc.); cyclic or linear ether based solvents (for example, tetrahydrofuran, dioxane, ethylene glycol, diethyl ether, etc.); and ester based solvents (for example, methyl acetate, ethyl acetate, n-butyl acetate, etc.). These solvents may be used singly or in combinations with two or more kinds thereof. The solvent which is used is preferably a solvent which is soluble in the binding resin. In the case where a combination of two or more kinds of solvents is used, its mixed solvent may be soluble in the binding resin.

For the purpose of dispersing the charge generating material in the resin, the coating solution for forming a charge generating layer is subjected to a dispersion treatment. Examples of a dispersion method include methods using a media dispersing machine (for example, a ball mill, a vibrating ball mill, an attritor, a sand mill, a horizontal sand mill, etc.) and methods using a media-less dispersing machine (for example, stirring, an ultrasonic dispersing machine, a roll mill, a high-pressure homogenizer, etc.). Furthermore, as the high-pressure homogenizer, a collision system for dispersing a dispersion in a high-pressure state through liquid-liquid collision or liquid-wall collision, a penetration system for dispersing a dispersion in a high-pressure state through penetration into a fine channel may be adopted.

Examples of a method for coating the coating solution for forming a charge generating layer on the undercoat layer 4 include a dip coating method, a push-up coating method, a wire bar coating method, a spray coating method, a blade coating method, a knife coating method and a curtain coating method.

A thickness of the charge generating layer 5 is set up preferably in the range of 0.01 μm or more and not more than 5 μm, and more preferably in the range of 0.05 μm or more and not more than 2.0 μm.

As described previously, the charge transporting layer 6 contains a coated insulating inorganic particle obtained by coating an insulating inorganic particle having a specific surface area of not more than 300 $m^2/g$ with an aromatic functional group-containing compound and a fluorine-containing organic particle.

In this specification, the specific surface area is measured by a generally used method. Specifically, the specific surface area is measured by, for example, a transmission method or a gas adsorption method. Though an analyzer using a gas adsorption method is not particularly limited, examples thereof include a fluid type specific surface area automatic analyzer FlowSorb III2305/2310 (manufactured by Shimadzu Corporation), an automatic specific surface area analyzer Gemini 2360/2375 (manufactured by Shimadzu Corporation) and an automatic surface area/porosimetry analyzer TriStar 3000.

Examples of the insulating inorganic particle include a silicon dioxide particle, an alumina particle, a zirconia particle and a magnesium oxide particle. These particles may be used singly or in combinations of two or more kinds thereof. Of these, a silicon dioxide particle and an alumina particle are preferable, and a silicon dioxide particle is more preferable from the viewpoint of electric characteristics of the electrophotographic photoreceptor.

When the specific surface area of the insulating inorganic particle exceeds 300 $m^2/g$, not only excellent durability is not obtainable, but reproducibility of a fine line or reproducibility of a halftone is lowered.

Though a lower limit of the specific surface area of the insulating inorganic particle is not particularly limited, from the viewpoint of easiness of use, the specific surface area is preferably 10 $m^2/g$ or more, a value of which is corresponding to one in commercially available products. From the viewpoints of handling and control of irregularities formed by the particle in case of use in a photoreceptor, the range of the specific surface area is more preferably 10 $m^2/g$ or more and not more than 300 $m^2/g$ or about 10 $m^2/g$ or more and not more than about 300 $m^2/g$, and further preferably 50 $m^2/g$ or more and not more than 200 $m^2/g$ or about 50 $m^2/g$ or more and not more than about 200 $m^2/g$.

Examples of the aromatic functional group contained in the compound which is used for the coating treatment include a phenyl ring, phenylethyl, a naphthalene ring and a pyridine ring. A phenyl ring is preferable from the viewpoint of availability of a treating agent.

Examples of the compound which is used for the coating treatment include a compound represented by the following formula (1).

$$(R^1)_k\text{—Si—}(OR^2)_{4-k} \quad (1)$$

In the foregoing formula (1), $R^1$ represents a phenyl group, an ethylphenyl group, a pyridylethyl group or a naphthyl group; $R^2$ represents an alkyl group; and k represents an integer of 1 or more and not more than 3.

When $R^2$ represents an alkyl group, $R^2$ is preferably an alkyl group having 1 or more and not more than 10 carbon atoms, and more preferably a methyl group or an ethyl group from the viewpoints of reactivity and availability. k is preferably 1 or 2.

The coating treatment of the insulating inorganic particle with the aromatic functional group-containing compound is carried out by, for example, a wet surface treatment method, a dry surface treatment method or the like. The wet surface treatment method is a method in which a surface treating agent is dissolved in an organic solvent; the surface treating agent is adsorbed onto an object while suspending it in the solvent; thereafter, the organic solvent is evaporated to dryness; and the object having the surface treating agent adsorbed thereonto is baked by heating, thereby covering the surface of the object. The dry surface treatment method is a method in which a surface treating agent in a liquid or gas state is adsorbed onto the surface of an object while not using a solvent at all and baked at it is, thereby coating the surface of the object.

A use amount of the aromatic functional group-containing compound in the coating treatment is not particularly limited. However, it is preferable that the aromatic functional group-containing compound is used in a proportion of 1% by weight or more and not more than 30% by weight on a weight basis of the insulating inorganic particle such that the surface of the insulating inorganic particle is thoroughly coated.

A content of the coated insulating inorganic particle in the charge transporting layer 6 is preferably 2% by weight or more and not more than 30% by weight, more preferably 4% by weight or more and not more than 20% by weight, and further preferably 4% by weight or more and not more than 10% by weight on the basis of the total solids content of the charge transporting layer 6. When the content of the coated insulating inorganic particle is less than 2% by weight, there is a tendency that a modification effect of the charge transporting layer 6 becomes small. On the other hand, when the content of the coated insulating inorganic particle exceeds 30% by weight, there is a tendency that dispersion failure or coagulation is easy to generate.

Examples of the fluorine-containing organic particle include a tetrafluoroethylene resin (PTFE), a trifluorochloroethylene resin, a hexafluoropropylene resin, a vinyl fluoride resin, a vinylidene fluoride resin, a difluorochloroethylene resin and particles composed of a copolymer thereof. These resins may be used singly or in combination of two or more kinds thereof. A tetrafluoroethylene resin and a vinylidene fluoride resin are preferable from the viewpoint of more strongly revealing the performances of fluorine.

A particle size of a primary particle, namely a non-coagulated particle, of the fluorine-containing organic particle is preferably 0.05 μm or more and not more than 1 μm or about 0.05 μm or more and not more than about 1 μm, and more preferably 0.1 μm or more and not more than 0.5 μm or about 0.1 μm or more and not more than about 0.5 μm. When the particle size of the primary particle is less than 0.05 μm, there is a tendency that coagulation at the time of dispersion is easy to advance. On the other hand, when the particle size of the primary particle exceeds 1 μm, there is a tendency that image quality failure is easy to generate. Also, an average sphericity of the fluorine based resin particle is preferably not more than 0.7. The average sphericity as referred to herein means an average of rate of spheroidization.

A content of the fluorine-containing organic particle in the charge transporting layer 6 is preferably 2% by weight or more and not more than 15% by weight, more preferably 4% by weight or more and not more than 12% by weight, and further preferably 5% by weight or more and not more than 10% by weight on the basis of the total solids content of the charge transporting layer 6. When the content of the fluorine-containing organic particle is less than 2% by weight, there is a tendency that a modification effect of the charge transporting layer 6 to be brought by dispersing the fluorine-containing organic particle becomes small. On the other hand, when the content of the fluorine-containing organic particle exceeds 15% by weight, there is a tendency that dispersibility is easily lowered; and also, there is a tendency that a lowering of light transmittance and a lowering of film strength are easy to generate.

For the purpose of making dispersion of the fluorine-containing organic particle uniform, a dispersing auxiliary agent of the fluorine-containing organic particle may be further incorporated into the charge transporting layer 6. Examples of the dispersing auxiliary agent include fluoroalkyl group-containing methacrylic copolymers.

As the fluoroalkyl group-containing methacrylic copolymer, a compound containing at least repeating units represented by the following formulae (I) and (II) is preferable.

(I)

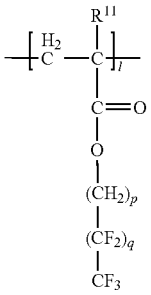

(II)

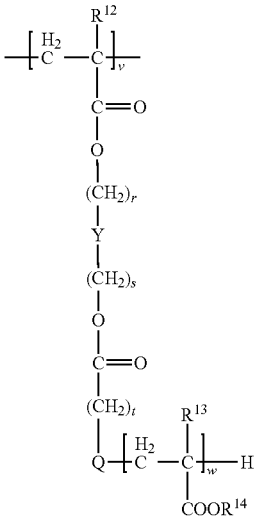

In the foregoing formulae (I) and (II), each of l, v and w represents a positive number of 1 or more; each of p, r, s and t represents 0 or a positive number of 1 or more; q represents a positive number of 1 or more and not more than 7; each of $R^{11}$, $R^{12}$, $R^{13}$ and $R^{14}$ represents a hydrogen atom or an alkyl group; Q represents an alkylene chain, a halogen-substituted alkylene chain, —S—, —O—, —NH— or a single bond; Y represents an alkylene chain, a halogen-substituted alkylene chain, —($C_zH_{2z-1}$(OH))— or a single bond; and z represents a positive number of 1 or more.

A weight average molecular weight of the fluoroalkyl group-containing methacrylic copolymer is preferably 10,000 or more and not more than 100,000, and more preferably 30,000 or more and not more than 100,000. When the weight average molecular weight of the fluoroalkyl group-containing methacrylic copolymer is 10,000 or more, dispersion stability of the fluorine based resin particle in the surface layer is excellent. Also, when the weight average molecular weight of the fluoroalkyl group-containing methacrylic copolymer is not more than 100,000, since compatibility with the binding resin contained in the surface layer is excellent, an interface between the copolymer and the binding resin according to the present exemplary embodiment does not work as a trap side of the charge, and even in repeated use under a high-temperature and high-humidity condition, a residual potential hardly increases.

The weight average molecular weight as referred to herein means a value measured by the following method.

The measurement is carried out using "HLC-8120GPC, SC-8020" (manufactured by Tosoh Corporation) as a gel permeation chromatograph (GPC) and two of "TSK gel, Super HM-H" (manufactured by Tosoh Corporation, 6.0 mm ID×15 cm) as a column and using THF (tetrahydrofuran) as an eluent. The experiment was carried out using an IR detector under an experimental condition of a sample concentration of 0.5%, a flow rate of 0.6 mL/min, a sample injection amount of 10 and a measurement temperature of 40° C. Also, a calibration curve is prepared from nine samples of a polystyrene standard sample of TSK Standard A-1000, A-2500, A-5000, F-1, F-2, F-4, F-10, F-40 and F-80, all of which are manufactured by Tosoh Corporation.

In fluoroalkyl group-containing methacrylic copolymer, a content ratio of the repeating unit represented by the formula (I) and the repeating unit represented by the formula (II), namely a UV ratio is preferably in the range of from 119 to 9/1, and more preferably in the range of from 3/7 to 7/3. When the l/v ratio falls within the range of from 1/9 to 9/1, the fluorine-containing organic particle may be well dispersed.

In the formulae (I) and (II), examples of the alkyl group represented by $R^{11}$, $R^{12}$, $R^{13}$ and $R^{14}$ include a methyl group, an ethyl group and a propyl group. As $R^{11}$, $R^{12}$, $R^{13}$ and $R^{14}$, a hydrogen atom and a methyl group are preferable, with a methyl group being more preferable.

Also, for the purpose of enhancing smoothness of the surface, a silicone oil represented by the following formula (2) may be further incorporated into the charge transporting layer 6.

Formula (2)

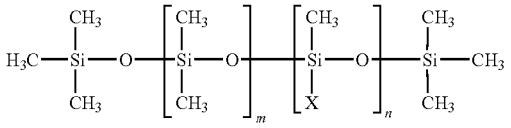

In the foregoing formula (2), in represents an integer of 1 or more; n represents an integer of 0 or more; and X represents a fluorine atom-containing group.

There may be the case where by using a fluorine-modified silicon oil whereby n is 1 or more, the performance for achieving smoothening may be enhanced as the need arises.

It is preferable that the fluorine-modified silicone oil contains a fluoroalkyl group as X.

A content of the silicone oil is not particularly limited so far as it falls within the range where desired characteristics are obtainable. However, it is preferably in the range of 0.1 ppm or more and not more than 1,000 ppm, and more preferably in the range of 0.5 ppm or more and not more than 500 ppm relative to the whole amount of a coating solution for forming a charge transporting layer as described later. When this content is less than 0.1 ppm, a sufficiently smooth surface is not obtainable, whereas when it exceeds 1,000 ppm, there is a tendency that electric characteristics are lowered such that a residual potential at the time of repeated use increases.

The charge transporting layer 6 includes, in addition to the foregoing components, a charge transporting material for revealing functions as the charge transporting layer and further a binding resin. Examples of the charge transporting material include hole transporting materials such as oxadiazole derivatives (for example, 2,5-bis(p-diethylaminophenyl)-1,3,4-oxadiazole, etc.), pyrazoline derivatives (for example, 1,3,5-triphenyl-pyrazoline, 1-[pyridyl-(2)]-3-(p-diethylaminostyryl)-5-(diethylaminostyryl)pyrazoline, etc.), aromatic tertiary amino compounds (for example, triphenylamine, N,N'-bis(3,4-dimethylphenyl)biphenyl-4-amine, tri(p-methylphenyl)aminyl-4-amine, dibenzylaniline, etc.), aromatic tertiary diamino compounds (for example, N,N'-bis(3-methylphenyl)-N,N'-diphenylbenzidine, etc.), 1,2,4-triazine derivatives (for example, 3-(4'-dimethylaminophenyl)-5,6-di-(4'-methoxyphenyl)-1,2,4-triazine, etc.), hydrazone derivatives (for example, 4-dimethylaminobenzaldehyde-1,1-diphenylhydrazone, etc.), quinazoline derivatives (for example, 2-phenyl-4-styryl-quinazoline, etc.), benzofuran derivatives (for example, 6-hydroxy-2,3-di(p-methoxyphenyl)benzofuran, etc.), α-stilbene derivatives (for example, p-(2,2-diphenylvinyl)-N,N-diphenylaniline, etc.), enamine derivatives, carbazole derivatives (for example, N-ethylcarbazole, etc.) and poly-N-vinylcarbazole and derivatives thereof; electron transporting materials such as quinone based compounds (for example, chloranil, bromoanthraquinone, etc.), tetracyanoquinodimethane based compounds, fluororenone based compounds (for example, 2,4,7-trinitirofluorenone, 2,4,5,7-tetranitro-9-fluorenone, etc), xanthone based compounds and thiophene compounds; and polymers containing a group composed of the foregoing compounds in a principal chain or side chain thereof. These charge transporting materials may be used singly or in combinations of two or more kinds thereof.

Examples of the binding resin in the charge transporting layer 6 include polycarbonate resins of a bisphenol A type or a bisphenol Z type or the like, acrylic resins, methacrylic resins, polyarylate resins, polyester resins, polyvinyl chloride resins, polystyrene resins, acrylonitrile-styrene copolymer resins, acrylonitrile-butadiene copolymer resins, polyvinyl acetate resins, polyvinyl formal resins, polysulfone resins, styrene-butadiene copolymer resins, vinylidene chloride-acrylonitrile copolymer resins, vinyl chloride-vinyl acetate-maleic anhydride resins, silicone resins, phenol-formaldehyde resins, polyacrylamide resins, polyamide resins, insulating resins (for example, chlorine rubbers, etc.) and organic photoconductive polymers (for example, polyvinylcarbazole, polyvinylanthracene, polyvinylpyrene, etc.). These binding resins may be used singly or in combinations of two or more kinds thereof.

The charge transporting layer 6 may be formed by, for example, coating a coating solution for forming a charge transporting layer obtained, by mixing the foregoing respective components with a prescribed solvent on the charge generating layer 5 and then drying it.

As the solvent which is used in the coating solution for forming a charge transporting layer, known organic solvents are useful. Examples of such a solvent include aromatic hydrocarbon based solvents (for example, toluene, chlorobenzene, etc.); aliphatic alcohol based solvents (for example, methanol, ethanol, n-propanol, isopropanol, n-butanol, etc.); ketone based solvents (for example, acetone, cyclohexanone, 2-butanone, etc.); halogenated aliphatic hydrocarbon based solvents (for example, methylene chloride, chloroform, ethylene chloride, etc.); cyclic or linear ether based solvents (for example, tetrahydrofuran, dioxane, ethylene glycol, diethyl ether, etc.); and ester based solvents (for example, methyl acetate, ethyl acetate, n-butyl acetate, etc.). These solvents may be used singly or in combinations with two or more kinds thereof. The solvent which is used is preferably a solvent which is soluble in the binding resin. In the case where a combination of two or more kinds of solvents is used, its mixed solvent may be soluble in the binding resin.

A blending ratio (weight ratio) between the charge transporting material and the binding resin in the charge transporting layer 6 is preferably in the range of from 10/1 to 1/5.

Examples of a method for dispersing the respective components in the coating solution for forming a charge transporting layer include methods using a media dispersing machine (for example, a ball mill, a vibrating ball mill, an attritor, a sand mill, a horizontal sand mill, etc.) and methods using a media-less dispersing machine (for example, stirring, an ultrasonic dispersing machine, a roll mill, a high-pressure homogenizer, etc.). Furthermore, as the high-pressure homogenizer, a collision system for dispersing a dispersion in a high-pressure state through liquid-liquid collision or liquid-wall collision, a penetration system for dispersing a dispersion in a high-pressure state through penetration into a fine channel may be adopted.

Examples of a method for coating the coating solution for forming a charge transporting layer on the charge generating layer 5 include usual methods such as a dip coating method, a push-up coating method, a wire bar coating method, a spray coating method, a blade coating method, a knife coating method and a curtain coating method.

A thickness of the charge transporting layer 6 is set up preferably in the range of 5 μm, or more and not more than 50 μm, and more preferably in the range of 10 μm or more and not more than 40 μm. Also, from the viewpoint of durability, the thickness of the charge transporting layer 6 as an outermost surface layer may be set up in the range of 25 μm or more and not more than 50 μm. Even when the outermost surface layer is made thick in this way, it is possible to make both durability and image quality compatible with each other at high levels.

By disposing the foregoing charge transporting layer 6 containing a specified coated insulating inorganic particle obtained by coating an insulating inorganic particle having a specified specific surface area with an aromatic functional group-containing compound and a fluorine-containing organic particle as the outermost surface layer, the electrophotographic photoreceptor according to the present exemplary embodiment is excellent in durability and capable of sufficiently reproducing a fine line and a halftone.

Meanwhile, examples of a method for contriving to enhance durability of an electrophotographic photoreceptor include (i) a technique for incorporating a fluorine based resin particle into an outermost surface layer of the photoreceptor and (ii) a technique for incorporating an inorganic particle into an outermost surface layer of the photoreceptor.

According to the technique (i), since a surface friction force of the outermost surface layer is lowered due to the fluorine based resin particle, influences of a stress of a blade may be reduced. On the other hand, since the majority of fluorine based resin particles are of a material system with a low hardness, the hardness of the film is easy to become low. Also, since a fluorine based resin particle is poor in dispersibility and easily coagulated, the fluorine based resin particle is easy to drop off from the film in a portion where coagulation of the fluorine based resin particle occurs. Though a lowering of the hardness of the film or dropping off of the fluorine based resin particle is disadvantageous regarding the durability, there may be the case where the durability is enhanced by incorporating a large amount of the fluorine based resin particle such that an effect for reducing the surface friction force is strongly revealed.

However, in a method for enhancing the durability by increasing the amount of the fluorine based resin particle, a lowering of a fine line density or density unevenness is caused, resulting in a lowering of the image quality. As to reasons why the image quality is lowered, it may be considered that disturbance is generated in incident light for forming a latent image due to a difference in refractive index between the fluorine based resin particle and a circumferential material, or coagulation of the fluorine based resin particle. Specifically, in the case where the coagulation of the fluorine based resin particle advances to an extent of the particle size the same as a wavelength of exposure, it causes scattering of the incident light, and therefore, it may be considered that when printed, reproducibility of a fine line portion is deteriorated, or image quality defects such as black spots and white spots are generated. The present inventors have confirmed that when the thickness of the outermost surface layer is made thick as 25 μm, such problems become noticeable.

According to technique (ii), while an effect for reducing the surface friction force is low, it is possible to enhance the strength of the film, whereby the durability is possibly enhanced. However, even in this, if it is intended to highly increase the durability of the photoreceptor, the inorganic particle is easy to drop off from the film, or slipping off of a toner is easy to occur due to irregularities formed by the inorganic particle, thereby easily causing an image quality defect.

On the other hand, in the present exemplary embodiment, as described previously, by combining a specified coated insulating inorganic particle with a fluorine-containing organic particle, it is possible to reveal excellent durability and to sufficiently reproduce a fine line and a halftone. As to reasons why such effects are obtainable, the present inventors may conjecture as follows.

First of all, in many cases, a binding resin or a charge transporting material which is used in a photosensitive layer contains a functional group connected by a conjugated double bond centering on an aromatic functional group. From the viewpoint of compatibility, since an insulating inorganic particle itself is low in compatibility with these materials, it may be considered that sufficient dispersibility is hardly obtainable. On the other hand, in case of the coated insulating inorganic particle according to the invention, in view of the fact that the insulating inorganic particle having a specified specific surface area is subjected to a coating treatment with the aromatic functional group-containing compound, the compatibility with the binding resin or charge transporting material is sufficiently improved, whereby it becomes possible to achieve good dispersion of the particle. According to this, it may be considered that coagulation of the particle is sufficiently suppressed and that effects for enhancing the strength and reducing the friction force to be brought by the inorganic particle are efficiently obtainable while preventing problems such as dropping off of the inorganic particle from occurring.

In comparison with a system of a fluorine-containing organic particle alone, according to the foregoing effects to be brought by the coated insulating inorganic particle according to the invention, even when the addition amount of the fluorine-containing organic particle is low, it is easy to obtain sufficient durability, and it is possible to efficiently reduce dispersion failure which is easily generated in the case where the amount of the fluorine-containing organic particle is high. Also, it is confirmed from sectional photographs that the insulating inorganic particle having been subjected to a coating treatment with the aromatic functional group-containing compound hardly impairs dispersion of the fluorine-containing organic particle, a reason of which, however, has not been elucidated yet.

In the light of the above, what by employing the coated insulating inorganic particle obtained by a coating treatment with the aromatic functional group-containing compound, high durability is obtainable while sufficiently suppressing the generation of an image quality defect which likely causes a lowering of a fine line density or density unevenness to be caused due to dispersion failure of the fluorine-containing organic particle is a reason why the effects of the invention are obtainable. While it may be considered that the effects of the invention are brought by a combination of the foregoing effects, it should not be construed that they are limited thereto.

In the case where an inorganic particle which does not have the configuration according to the invention, for example, an inorganic particle having been subjected to a coating treatment with a surface treating agent such as a silicone oil and an alkyl silane coupling agent, is mixed with a fluorine based resin particle, dispersion of the fluorine based resin particle is often deteriorated, whereby the film durability in a coagulated portion of the fluorine based resin is lowered, or obstructions such as an image quality defect are generated.

Also, when the specific surface area of the insulating inorganic particle exceeds 300 $m^2/g$, the electric characteristics are not sufficiently obtainable. It may be considered that when the amount of the aromatic functional group-containing compound for coating the particle increases, the aromatic functional group-containing compound is easy to elute into the outermost surface layer, thereby causing an electrical obstruction by a trap. Also, an insulating inorganic particle having a specific surface area exceeding 300 $m^2/g$ is easy to cause coagulation by itself. In an inorganic particle which is not subjected to a coating treatment, dispersibility is deteriorated, the resulting film is brittle in a coagulated portion, and durability is deteriorated.

The respective layers configuring the photosensitive layer 3 may contain additives such as an antioxidant, a light stabilizer and a heat stabilizer, depending upon the purpose. By incorporating such an additive, in the case where the electrophotographic photoreceptor 1 is used in an image forming apparatus such as an electrophotographic apparatus, deterioration of the photoreceptor to be caused due to ozone or a nitrogen oxide generated within the image forming apparatus, light or heat may be prevented from occurring.

Examples of the antioxidant include hindered phenols, hindered amines, p-phenylenediamine, arylalkanes, hydroquinone, spirochroman, spiroindanone and derivatives thereof; organic sulfur compounds; and organophosphorus compounds. Examples of the light stabilizer include derivatives of benzophenone, benzazole, dithiocarbamate and tetramethylpiperidine.

While a preferred exemplary embodiment of the electrophotographic photoreceptor of the invention has been describe, it should not be construed that the electrophotographic photoreceptor of the invention is limited thereto. For example, a configuration where the undercoat layer 4 is omitted from the electrophotographic photoreceptor shown in FIG. 1 may be adopted.

As described previously, the electrophotographic photoreceptor may be a so-called single-layered photoreceptor as in the electrophotographic photoreceptor 1 shown in FIG. 4. In that case, the same material as that used in the charge transporting layer in the function-separated photosensitive layer is useful as the charge transporting material; the same material as that used in the charge generating layer in the function-separated photosensitive layer is useful as the charge generating material; and the same material as the binding material used in each of the charge generating layer and the charge transporting layer in the function-separated photosensitive layer is useful as the binding resin. Also, for the solvent and coating method to be used for coating, the same solvent and coating method in each of the foregoing layers are useful. A thickness of the single-layered photosensitive layer is preferably about 5 μm or more and not more than 50 μm, and more preferably 10 μm or more and not more than 40 μm.

Furthermore, the electrophotographic photoreceptor 1 may be an electrophotographic photoreceptor provided with the protective layer 7 as shown in FIGS. 2, 3 and 5. In that case, the protective layer 7 includes the foregoing coated insulating inorganic particle and fluorine-containing organic particle. The protective layer 7 may be configured of a known resin cured film including a curable resin and a charge transporting material, a known film formed by incorporating a conductive material into an appropriate binding resin, or the like.

Also, an interlayer containing a binding resin, may be further provided on the undercoat layer 4 for the purpose of enhancing the electric characteristics, enhancing the image quality, enhancing image quality retention properties or enhancing adhesiveness to the photosensitive layer or other purposes.

Examples of the binding resin which is used in the interlay include polymer resin compounds such as acetal resins (for example, polyvinyl butyral, etc.), polyvinyl alcohol resins, casein, polyimide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins and melamine resins; and besides, organometallic compounds containing a zirconium, titanium, aluminum, manganese or silicon atom or the like. These compounds may be used singly or in admixture of plural kinds thereof or a polycondensate. Of these, organometallic compounds containing zirconium or silicon are excellent in performance, for example, they are low in a residual potential, small in potential changes to be caused due to the environment and small in potential changes to be caused due to the repeated used.

Similar to other photosensitive layers, the interlayer may be provided by preparing a binding resin-containing coating solution for forming an interlayer, coating it on the undercoat layer 4 and then drying it.

As the solvent which is used in the coating solution for forming an interlayer, known organic solvents are useful. Examples of such a solvent include aromatic hydrocarbon based solvents (for example, toluene, chlorobenzene, etc.); aliphatic alcohol based solvents (for example, methanol, ethanol, n-propanol, isopropanol, n-butanol, etc.); ketone based solvents (for example, acetone, cyclohexanone, 2-butanone, etc.); halogenated aliphatic hydrocarbon based solvents (for example, methylene chloride, chloroform, ethylene chloride, etc.); cyclic or linear ether based solvents (for example, tetrahydrofuran, dioxane, ethylene glycol, diethyl ether, etc.); and ester based solvents (for example, methyl acetate, ethyl acetate, n-butyl acetate, etc.). These solvents may be used singly or in combinations with two or more kinds thereof. The solvent which is used is preferably a solvent which is soluble in the binding resin. In the case where a combination of two or more kinds of solvents is used, its mixed solvent may be soluble in the binding resin.

Examples of a method for coating the coating solution for forming an interlayer on the undercoat layer 4 include usual methods such as a dip coating method, a push-up coating method, a wire bar coating method, a spray coating method, a blade coating method, a knife coating method and a curtain coating method.

In addition to an improvement of coating properties of an upper layer, the interlayer works as an electrical blocking layer. However, when the thickness of the interlayer is too thick, an electrical obstruction becomes too strong, thereby causing desensitization or an increase of a potential due to repeated use. Accordingly, in case of providing an interlayer, a thickness of the interlayer is set up in the range of 0.1 μm or more and not more than 3 μm. Also, the interlayer may be used as the undercoat layer 4.

The foregoing electrophotographic photoreceptor 1 may be used in an image forming apparatus for forming a color or black-and-white image by an image forming method of for example, an electrophotographic system, an electrostatic recording system, sonography, a magnetic recording system, etc. Examples of such an image forming apparatus include a copying machine, a printer and a facsimile.

(Image Forming Apparatus and Process Cartridge)

Figure 6:
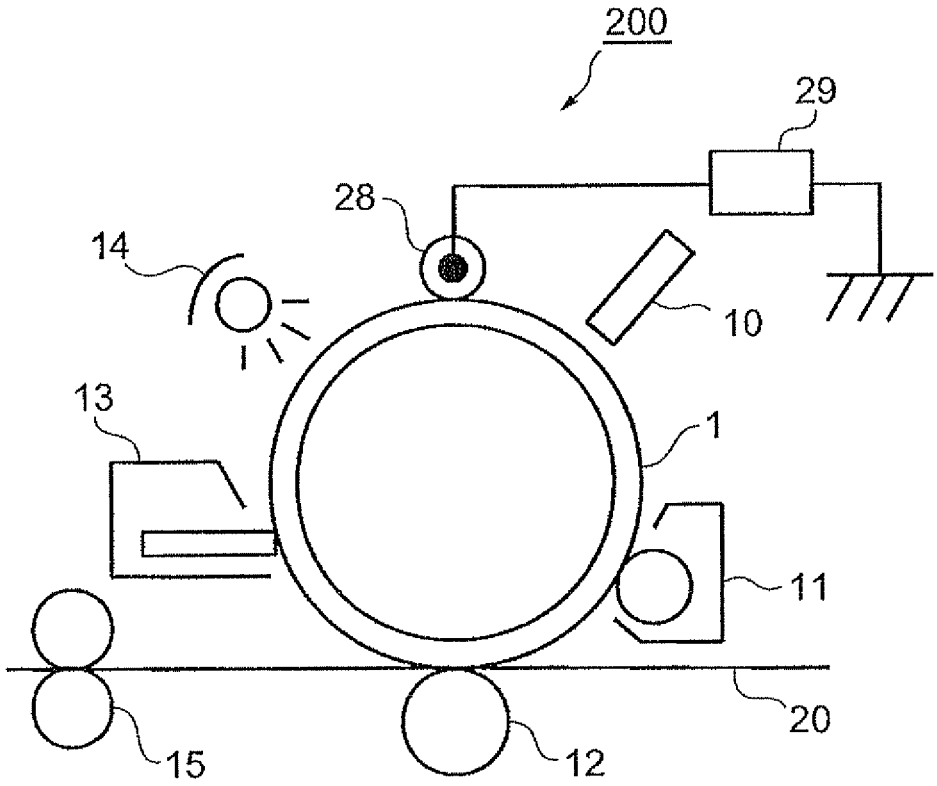
FIG. 6 is a schematic sectional view showing a preferred exemplary embodiment of an image forming apparatus.

FIG. 6 is a schematic sectional view showing a preferred exemplary embodiment of an image forming apparatus. An image forming apparatus 200 shown in FIG. 6 is provided with the electrophotographic photoreceptor 1 according to the foregoing present exemplary embodiment; a charging device (contact charging device) 28 of a contact charging system for charging the electrophotographic photoreceptor 1; a power source 29 connected to the charging device 28; an exposing device 10 for exposing the electrophotographic photoreceptor 1 to be charged by the charging device 28 to form an electrostatic latent image; a developing device 11 for developing the electrostatic latent image formed by the exposing device 10 with a toner to form a toner image; a transfer device 12 for transferring the toner image formed by the developing device 11 onto a transfer medium 20; a cleaning device 13; a destaticizer (erasing light exposing device) 14; and a fixing device 15.

Though the destaticizer 14 is not always necessary, by providing the destaticizer 14, when the electrophotographic photoreceptor 1 is repeatedly used, a phenomenon wherein a residual potential of the electrophotographic photoreceptor 1 is carried into a next cycle may be prevented from occurring. According to this, the image quality may be more enhanced.

The contact charging device 28 includes a charging roller, and a voltage is impressed to the charging roller during charging the electrophotographic photoreceptor 1. The voltage to be impressed may be any of a direct current voltage or an alternating current voltage having a direct current voltage superimposed thereon. Also, the range of the voltage to be impressed is properly regulated depending upon a required charging potential of the photoreceptor. In case of using a direct current voltage, the voltage is a positive or negative voltage of preferably 50 V or more and not more than 2,000 V, and more preferably 100 V or more and not more than 1,500 V; and in case of superimposing an alternating voltage, a voltage between peeks is preferably 400 V or more and not more than 1,800 V, more preferably 800 V or more and not more than 1,600 V, and further preferably 1,200 V or more and not more than 1,600 V. A frequency of the alternating current voltage is preferably 50 Hz or more and not more than 20,000 V, and more preferably 100 Hz or more and not more than 5,000 V.

As the charging roller, a roller in which an elastic layer, a resistive layer, a protective layer or the like is provided on the peripheral surface of a core material is preferably used. By bringing the charging roller into contact with the electrophotographic photoreceptor 1, even when a driving unit is not particularly provided, the charging roller rotates at the same peripheral velocity as the electrophotographic photoreceptor 1 to function as a charging unit. The charging roller may be installed with a driving unit such that it is rotated at a peripheral velocity which is different from that of the electrophotographie photoreceptor 1 and charged.

Examples of the exposing device 10 include optical devices capable of imagewise exposing the surface of the electrophotographic photoreceptor in a desired manner with a light source such as a semiconductor laser, LED (light emitting diode) and a liquid crystal shutter.

As the developing device 11, developing devices using a normal or reversal developer of a one-component system or a two-component system or the like, which have hitherto been known, are useful. A shape of the toner which is used in the developing device 11 is not particularly limited, and it may be an amorphous or spherical shape or other specific shape.

Examples of the transfer device 12 include, in addition to roller-shaped contact charge members, contact type transfer charging units using a belt, a film, a rubber blade, etc. and scorotron transfer charging units or corotron transfer charging units utilizing corona discharge.

The cleaning device 13 is a device for removing a residual toner deposited on the surface of the electrophotographic photoreceptor 1 after the transfer step to clean up the surface of the electrophotographic photoreceptor. The electrophotographic photoreceptor 1, the surface of which has been cleaned up by the cleaning device 13, is repeatedly used for a process for forming an image. Examples of the cleaning device 13 which may be used include a cleaning blade, a cleaning brush and a cleaning roller. Of these, a cleaning blade is preferable for use. Also, examples of a material of the cleaning blade include a urethane rubber, a neoprene rubber and a silicone rubber.

Figure 7:
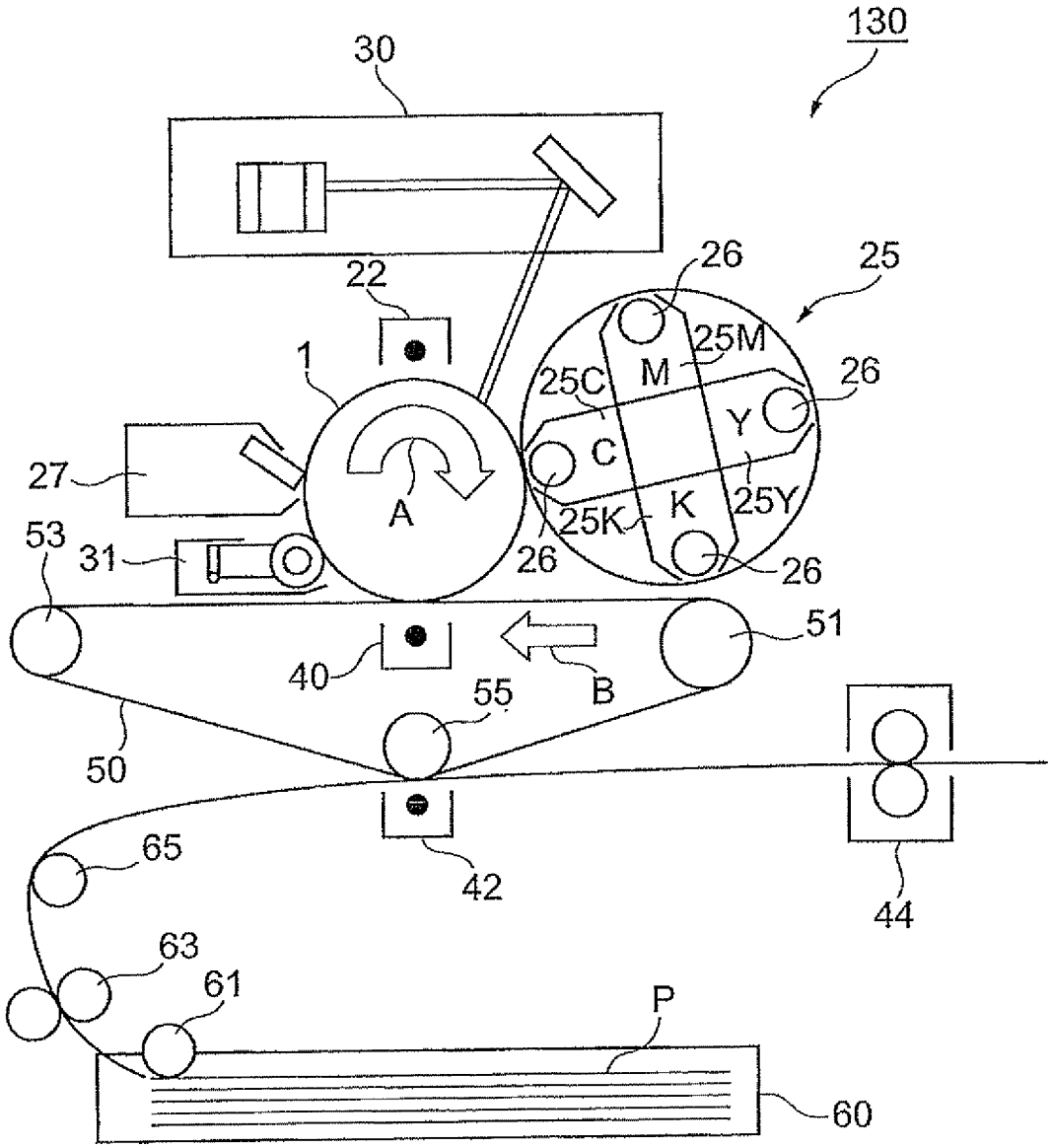
FIG. 7 is a schematic sectional view showing another preferred exemplary embodiment of an image forming apparatus.

FIG. 7 is a schematic sectional view showing another preferred exemplary embodiment of an image forming apparatus. An image forming apparatus 130 shown in FIG. 7 is an image forming apparatus of a so-called four-cycle system for forming a toner image of a plurality of colors by a single electrophotographic photoreceptor. The image forming apparatus 130 has a photoreceptor drum (electrophotographic photoreceptor) rotating in the direction shown by an arrow A in the drawing at a prescribed rotation speed with a driving device (not illustrated), and a charging device 22 for charging the peripheral surface of the photoreceptor drum 1 is provided above the photoreceptor drum 1.

Also, an exposing device 30 provided with a plane emission laser array as an exposure light source is disposed above the charging device 22. The exposing device 30 modulates plural laser beams emitted from a light source corresponding to an image to be formed and deflects in the main scanning direction, thereby scanning the peripheral surface of the photoreceptor drum 1 in parallel to an axis of the photoreceptor drum 1. According to this, an electrostatic latent image is formed on the peripheral surface of the charged photoreceptor drum 1.

A developing device 25 is disposed on the side of the photoreceptor drum 1. The developing device 25 has a roller-shaped container body which is rotatably disposed. The container body has four containers formed therein, and developing units 25Y, 25M, 25C and 25K are provided in the containers, respectively. The developing units 25Y, 25M, 25C and 25K are each provided with a developing roller 26 and store toners of Y (yellow), M (magenta), C (cyan) and K (black) colors, respectively.

A full color image is formed in the image forming apparatus 130 through four revolutions of the photoreceptor drum 1. That is, during the four revolutions of the photoreceptor drum 1, an operation is repeated such that the charging device 22 charges the peripheral surface of the photoreceptor drum 1, and the exposing device 30 scans the peripheral surface of the photoreceptor drum 1 with a laser beam modulated corresponding to image data of any one of Y (yellow), M (magenta), C (cyan) and K (black) colors expressing color images to be formed, respectively while switching the image data used for modulating the laser beam after completing one revolution of the photoreceptor drum 1. Also, the developing device 25 actuates one of the developing units 25Y, 25M, 25C and 25K, the developing roller 26 of which is in contact with the peripheral surface of the photoreceptor drum 1, to develop an electrostatic latent image formed on the peripheral surface of the photoreceptor drum 1 into a specified color, and the operation is repeated by rotating the container body so as to switch the developing units used for developing the electrostatic latent image after completing one revolution of the photoreceptor drain 1. According to this, toner images of Y (yellow), M (magenta), C (cyan) and K (black) colors are formed on the peripheral surface of the photoreceptor drum 1 sequentially per one revolution of the photoreceptor drum 1.

Also, an endless intermediate transfer belt 50 is disposed under the photoreceptor drum 1. The intermediate transfer belt 50 is stretched among rollers 51, 53 and 55 and disposed such that the peripheral surface thereof comes in contact with the peripheral surface of the photoreceptor drum 1. The rollers 51, 53 and 55 are rotated by transmitting a driving force of a non-illustrated motor, thereby rotating the intermediate transfer belt 50 in the direction shown by an arrow B in the drawing.

On the side of the intermediate transfer belt 50 opposite to the photoreceptor drum 1, a transfer device (transfer unit) 40 is disposed, and the toner images of Y (yellow), M (magenta), C (cyan) and K (black) colors which have been successively formed on the peripheral surface of the photoreceptor drum 1 are transferred for every color onto the image forming surface of the intermediate transfer belt 50 with the transferring device 40, and all of the images of Y (yellow), M (magenta), C (cyan) and K (black) colors are finally stacked on the intermediate transfer belt 50.

Also, on the side of the photoreceptor drum 1 opposite to the developing device 25, a lubricant feeding device 31 and a cleaning device 27 are disposed on the peripheral surface of the photoreceptor drum 1. After transferring a toner image formed on the peripheral surface of the photoreceptor drum 1 onto the intermediate transfer belt 50, a lubricant is fed to the peripheral surface of the photoreceptor drum 1 by the lubricant feeding device 31, and a region of the peripheral surface where the toner image having been transferred is kept is cleaned up by a cleaning device 27.

A paper feeding device 60 is disposed beneath the intermediate transfer belt 50, and a large number of sheets of a copying paper P as a recording material are stacked and contained in the paper feeding device 60. A pickup roller 61 is disposed at the obliquely upper left of the paper feeding device 60, and a pair of rollers 63 and a roller 65 are disposed in this order on the downstream side of the pickup direction of the copying paper P by the pickup roller 61. The recording paper located uppermost in a stacked state is picked up from the paper feeding device 60 by rotating the pickup roller 61 and conveyed by the pair of rollers 63 and the roller 65.

Also, a transfer device 42 is disposed on the side of the intermediate transfer belt 50 opposite to the roller 55. The copying paper P conveyed by the pair of rollers 63 and the roller 65 is delivered between the intermediate transfer belt 50 and the transfer device 42, and the toner image formed on the image forming surface of the intermediate transfer belt 50 is transferred by the transferring device 42. A fixing device 44 equipped with a pair of fixing rollers is disposed on the downstream side in the conveying direction of the copying paper P relative to the transfer device 42. The toner image transferred onto the paper P is melted and fixed thereon by the fixing device 44, and the copying paper P having the toner image fixed thereon is delivered to the outside of the image forming apparatus 130 and placed on a paper delivery tray (not illustrated).

Figure 8:
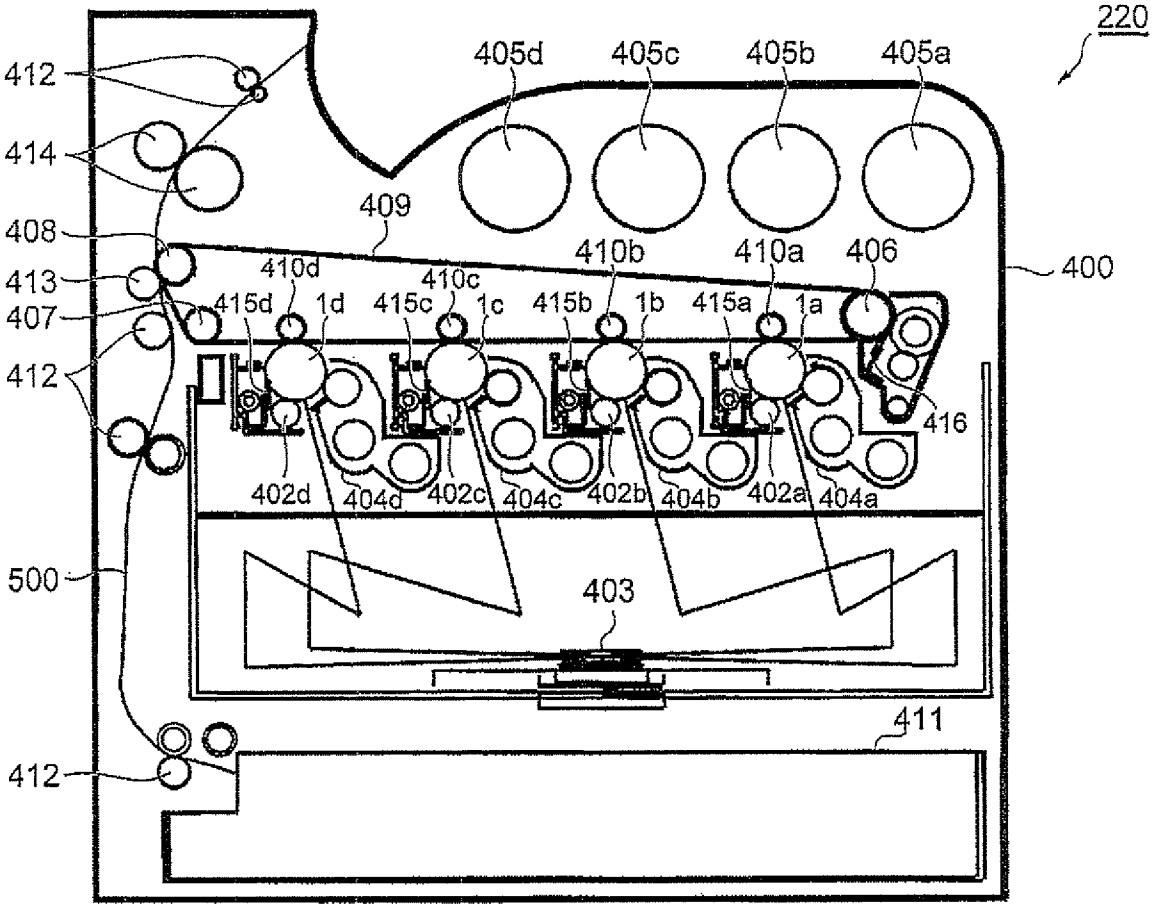
FIG. 8 is a schematic sectional view showing other preferred exemplary embodiment of an image forming apparatus.

FIG. 8 is a schematic sectional view showing other preferred exemplary embodiment of an image forming apparatus. An image forming apparatus 220 shown in FIG. 8 is an image forming apparatus of an intermediate transfer system, and in a housing 400, four electrophotographic photoreceptors 1*a* to 1*d* (for example, the electrophotographic photoreceptor 1*a* is able to form an image composed of a yellow color; the electrophotographic photoreceptor 1*b* is able to form an image composed of a magenta color; the electrophotographic photoreceptor 1*c* is able to form an image composed of a cyan color; and the electrophotographic photoreceptor 1*d* is able to form an image composed of a black color, respectively) are disposed in parallel to each other along an intermediate transfer belt 409. Here, the electrophotographic photoreceptors 1*a* to 1*d* which are mounted on the image forming apparatus 220 are each the electrophotographic photoreceptor according to the foregoing present exemplary embodiment.

The electrophotographic photoreceptors 1*a* to 1*d* are each rotatable in a prescribed direction (a counterclockwise direction in the drawing); and charging rollers (charging devices) 402*a* to 402*d*, developing devices 404*a* to 404*d*, primary transfer rollers (transfer devices) 410*a* to 410*d* and cleaning blades 415*a* to 415*d* are disposed in the rotation direction thereof. The developing devices 404*a* to 404*d* are able to feed toners of four black, yellow, magenta and cyan colors contained in toner cartridges 405*a* to 405*d*, respectively. Also, the primary transfer rollers 410*a* to 410*d* come into contact with the electrophotographic photoreceptors 1*a* to 1*d*, respectively via the intermediate transfer belt 409.

Furthermore, a laser beam source (exposing device) 403 is disposed at a prescribed location within the housing 400. A laser beam emitted from the laser beam source 403 is able to be irradiated on the surface of each of the electrophotographic photoreceptors 1*a* to 1*d* after charging. According to this, respective steps of charging, exposure, development, primary transfer and cleaning are successively carried out in the rotation step of the electrophotographic photoreceptors 1*a* to 1*d*, and the toner images of the respective colors are superimposed and transferred onto the intermediate transfer belt 409.

The intermediate transfer belt 409 is supported with a prescribed tension by a driving roller 406, a backup roller 408 and a tension roller 407. The intermediate transfer belt 409 is rotatable without generating deflection by means of rotation of these rollers. Also, a secondary transfer roller 413 is disposed so as to come into contact with the backup roller 408 via the intermediate transfer belt 409. The intermediate transfer belt 409 which has gone between the backup roller 408 and the secondary transfer roller 413 is cleaned up by, for example, a cleaning blade 416 disposed in the vicinity of the driving roller 406 and then repeatedly provided for a next process for forming an image.

Also, a tray (transfer medium tray) 411 is provided at a prescribed location within the housing 400. A transfer medium 500 such as paper within the tray 411 is successively conveyed between the intermediate transfer belt 409 and the secondary transfer roller 413 and further between two fixing rollers 414 coming into contact with each other by conveying rollers 412 and then outputted outside of the housing 400.

In the foregoing description, while the case of using the intermediate transfer belt 409 as an intermediate transfer body has been described, the intermediate transfer body may be in a belt form as in the foregoing intermediate transfer belt 409, or may be in a drum form. In case of adopting a configuration of a belt shape as the intermediate transfer body, resin materials made of a resin which has hitherto been known are useful as a substrate. Specific examples thereof include resin materials such as polyimide resins, polycarbonate (PC) resins, polyvinylidene fluoride (PVF), polyalkylene terephthalates (PAT), ethylene tetrafluoroethylene copolymer (ETFE)/PC, ETFE/PAT and PC/PAT blend materials, polyesters, polyetheretherketones and polyamides; and resins materials composed of such a resin material as a major raw material. Also, a blend of a resin material and an elastic material is useful.

Figure 9:
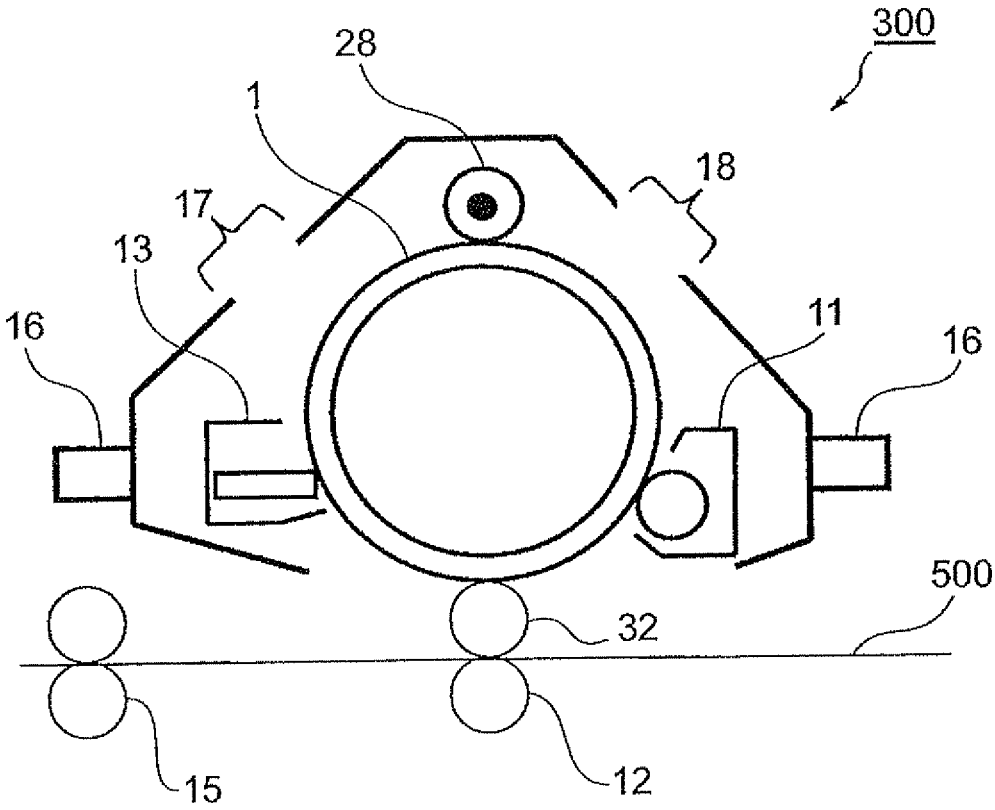
FIG. 9 is a schematic sectional view showing a preferred exemplary embodiment of a process cartridge.

FIG. 9 is a schematic sectional view showing a preferred exemplary embodiment of a process cartridge provided with the electrophotographic photoreceptor of the foregoing exemplary embodiment. A process cartridge 300 shown in FIG. 9 is a process cartridge obtained by combining the foregoing electrophotographic photoreceptor 1 according to the invention with the charging device 28, the developing device 11, the cleaning device (cleaning unit) 13, an opening 18 for exposure, an opening 17 for destaticization and exposure and an installing rail 16 and integrating them. Also, the process cartridge 300 has a configuration in which the transfer system of the transfer device 12 adopts an intermediate transfer system for transferring a toner image onto the transfer medium 500 via an intermediate transfer body 32.

This process cartridge 300 is detachable to an image forming apparatus main body composed of the transfer device 12, the fixing device 15 and non-illustrated other configuration portions and configures an image forming apparatus along with the image forming apparatus main body. Such a process cartridge 300 is applicable to, for example, all of the image forming apparatuses shown in FIGS. 6 to 8.

According to the foregoing image forming apparatus and process cartridge, it is possible to provide an electrophotographic cartridge and an electrophotographic apparatus, each of which even when vibration is added, or it is stored over a long period of time, does not cause fluctuations of electric characteristics or image defects.

The transfer medium according to the invention is not particularly limited so far as it is a medium for transferring a toner image formed on an electrophotographic photoreceptor. For example, in the case where an image is transferred onto a transfer medium, for example, paper or the like directly from an eleetrophotographic photoreceptor, the paper or the like is the transfer medium. Also, in case of using an intermediate transfer body, the intermediate transfer body is the transfer medium.

EXAMPLES

The invention is hereunder described in more detail with reference to the following Examples and Comparative Examples, but it should not be construed that the invention is limited thereto.

Example 1

100 parts by weight of zinc oxide (manufactured by Tayca Corporation, average particle size: 70 nm, specific surface area value: 15 $m^2/g$) and 500 parts by weight of methanol are stirred and mixed, 1.25 parts by weight of KBM603 (manufactured by Shin-Etsu Chemical Co., Ltd.) as a silane coupling agent is further added thereto, and the mixture is stirred for 2 hours. Thereafter, the methanol is evaporated off by means of vacuum distillation, and the residue is baked at 120° C. for 3 hours to obtain a silane coupling agent-surface treated zinc oxide fine particle.

60 parts by weight of the thus surface treated zinc oxide fine particle, 0.6 parts by weight of alizarine, 13.5 parts by weight of a blocked isocyanate (SUMIDULE 3175, produced by Sumitomo Bayer Urethane Co., Ltd.) as a curing agent and 15 parts by weight of a butyral resin (S-LEC BM-1, produced by Sekisui Chemical Co., Ltd.) are mixed with 85 parts by weight of methyl ethyl ketone. 38 pats by weight of the solution obtained by mixing and 25 parts by weight of methyl ethyl ketone are mixed and dispersed for 4 hours by a sand mill using glass beads having a diameter of 1 mm to obtain a dispersion. 0.005 parts by weight of dioctyltin dilaurate as a catalyst and 4.0 parts by weight of a silicone resin particle (TOSPEARL 145, manufactured by GE Toshiba Silicones Co., Ltd.) are added to the obtained dispersion to obtain a coating composition for forming a undercoat layer. The obtained coating composition for forming a undercoat layer is coated on an aluminum substrate having a diameter of 30 mm by a dip coating method and dried and cured at 180° C. for 40 minutes to form a undercoat layer having a thickness of 25 μm.

Subsequently, a mixture composed of 15 parts by weight of a chlorogallium phthalocyanine crystal having strong diffraction peaks of at least 7.4°, 16.6°, 25.5° and 28.3° at Bragg angles (2θ±0.2°) on CuKα characteristic X-ray; 10 parts by weight of a vinyl chloride-vinyl acetate copolymer resin (VMCH, manufactured by Nippon Unicar Co., Ltd.) and 300 parts by weight of n-butyl alcohol, and the mixture is dispersed for 4 hours by a sand mill using glass beads having a diameter of 1 mm to obtain a coating solution for charge generating layer. The obtained coating solution for charge generating layer is subjected to dip coating on the foregoing undercoat layer and then dried to form a charge generating layer having a thickness of 0.2 μm.

Subsequently, 10 parts by weight of phenyltrimethoxysilane as a surface treating agent is sprayed on 100 parts by weight of silicon dioxide (manufactured by Nippon Aerosil Co., Ltd., average particle size: 40 nm, specific surface area value: 50 $m^2/g$) and baked at 120° C. for 3 hours to obtain a coated silicon dioxide fine particle. Thereafter, 0.5 parts by weight of the coated silicon dioxide fine particle, 1.0 part by weight of a tetrafluoroethylene resin particle (average particle size: 0.2 μm), 0.01 parts by weight of a fluoroalkyl group-containing methacrylic copolymer containing repeating units represented by the following formulae (I) and (II) (weight average molecular weight: 30,000), 4 parts by weight of tetrahydrofuran and 1 part by weight of toluene are mixed, and the mixture is stirred for 48 hours while keeping a liquid temperature at 20° C. to obtain a suspension (hereinafter referred to as "liquid A").

(I)

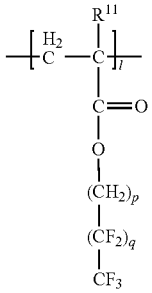

(II)

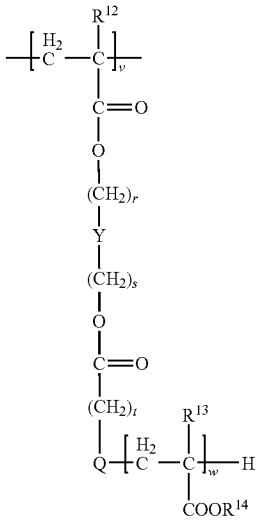

In the foregoing formulae (I) and (II), l/v/w is 1/1/1; p is 3; q is 3; r is 2; s is 2; and t is 2. Also, each of $R^{11}$, $R^{12}$ and $R^{13}$ is H; $R^{14}$ is $CH_3$; Q is —O; and Y is —(CH(OH))—.

On the other hand, 2 parts by weight of N,N'-bis(3-methylphenyl)-N,N'-diphenylbenzidine, 2 parts by weight of N,N'-bis(3,4-dimethylphenyl)biphenyl-4-amine and 6 parts by pass of a bisphenol Z type polycarbonate resin (viscosity average molecular weight: 40,000) as charge transporting materials and 0.1 parts by weight of 2,6-di-t-butyl-4-methylphenol as an antioxidant are mixed, and 24 parts by weight of tetrahydrofuran and 11 parts by weight of toluene are further mixed therewith to obtain a mixed solution (hereinafter referred to as "liquid B").

Then, the liquid A is added to the liquid B, followed by stirring and mixing. Thereafter, a dispersion treatment while elevating a pressure to 500 $kgf/cm^2$ using a high-pressure homogenizer installed with a penetration type chamber having a fine channel (manufacture by Yoshida Machinery Co., Ltd.) is repeated six times, 5 ppm (on the basis of the whole amount of the coating solution) of a fluorine-modified silicone oil (a trade name: FL-100, manufactured by Shin-Etsu Silicone Co., Ltd.) is added to the resulting solution, and the mixture is thoroughly stirred to obtain a coating solution for forming a charge transporting layer. The obtained coating solution for forming a charge transporting layer is coated on the charge generating layer and then dried at 115° C. for 40 minutes to form a change transporting layer having a thickness of 32 p.m. There is thus obtained an electrophotographic photoreceptor.

Example 2

A coated silicon dioxide fine particle is prepared in the same manner as in Example 1, except that 10 parts by weight of 2-phenylethyltrimethoxysilane is used as the surface treating agent in place of the phenyltrimethoxysilane. Then, an electrophotographic photoreceptor is obtained in the same manner as in Example 1, except that this coated silicon dioxide fine particle is used.

Example 3

A coated silicon dioxide fine particle is prepared in the same manner as in Example 1, except that 10 parts by weight of 1-naphthyltrimethoxysilane is used as the surface treating agent in place of the phenyltrimethoxysilane. Then, an electrophotographic photoreceptor is obtained in the same manner as in Example 1, except that this coated silicon dioxide fine particle is used.

Example 4

A coated silicon dioxide fine particle is prepared in the same manner as in Example 1, except that 10 parts by weight of 4-pyridylethyltriethoxysilane is used as the surface treating agent in place of the phenyltrimethoxysilane. Then, an electrophotographic photoreceptor is obtained in the same manner as in Example 1, except that this coated silicon dioxide fine particle is used.

Example 5

A coated silicon dioxide fine particle is prepared in the same manner as in Example 1, except that silicon dioxide having an average particle size of 300 nm and a specific surface area value of 11.3 $m^2/g$ is used as the insulating inorganic particle and that 10 parts by weight of phenyltrimethoxysilane (surface treating agent) is used relative to 100 parts by weight of silicon dioxide. Then, an electrophotographic photoreceptor is obtained in the same manner as in Example 1, except that this coated silicon dioxide fine particle is used.

Example 6

A coated silicon dioxide fine particle is prepared in the same manner as in Example 1, except that silicon dioxide having an average particle size of 20 nm and a specific surface area value of 90 $m^2/g$ is used as the insulating inorganic particle and that 10 parts by weight of phenyltrimethoxysilane (surface treating agent) is used relative to 100 parts by weight of silicon dioxide. Then, an electrophotographic photoreceptor is obtained in the same manner as in Example 1, except that this coated silicon dioxide fine particle is used.

Example 7

A coated silicon dioxide fine particle is prepared in the same manner as in Example 1, except that silicon dioxide having an average particle size of 14 nm and a specific surface area value of 150 $m^2/g$ is used as the insulating inorganic particle and that 10 parts by weight of phenyltrimethoxysilane (surface treating agent) is used relative to 100 parts by weight of silicon dioxide. Then, an electrophotographic photoreceptor is obtained in the same manner as in Example 1, except that this coated silicon dioxide fine particle is used.

Example 8

A coated silicon dioxide fine particle is prepared in the same manner as in Example 1, except that silicon dioxide having an average particle size of 7 nm and a specific surface area value of 300 $m^2/g$ is used as the insulating inorganic particle and that 10 parts by weight of phenyltrimethoxysilane (surface treating agent) is used relative to 100 parts by weight of silicon dioxide. Then, an electrophotographic photoreceptor is obtained in the same manner as in Example 1, except that this coated silicon dioxide fine particle is used.

Example 9

A coated alumina fine particle is prepared in the same manner as in Example 1, except that alumina ($Al_2O_3$) having an average particle size of 31 μm and a specific surface area value of 33 $m^2/g$ is used as an insulating inorganic fine particle in place of the silicon dioxide and that 10 parts by weight of phenyltrimethoxysilane (surface treating agent) is used relative to 100 parts by weight of alumina. Then, an electrophotographic photoreceptor is obtained in the same manner as in Example 1, except that this coated alumina fine particle is used.

Comparative Example 1

An electrophotographic photoreceptor is obtained in the same manner as in Example 1, except that the tetrafluoroethylene resin particle is not blended and that the fluoroalkyl group-containing methacrylic copolymer is not blended.

Comparative Example 2

An electrophotographic photoreceptor is obtained in the same manner as in Example 1, except that the coated insulating inorganic particle is not blended and that at the time of preparing the liquid A, the amount of the tetrafluoroethylene resin particle is changed to 1.4 parts by weight.

Comparative Example 3

A coated silicon dioxide fine particle is prepared in the same manner as in Example 1, except that silicon dioxide (silica gel) having an average particle size of not more than 100 nm and a specific surface area value of 690 $m^2/g$ is used as the insulating inorganic particle and that 10 parts by weight of phenyltrimethoxysilane (surface treating agent) is used relative to 100 parts by weight of silicon dioxide. Then, an electrophotographic photoreceptor is obtained in the same manner as in Example 1, except that this coated silicon dioxide fine particle is used.

Comparative Example 4

A coated silicon dioxide fine particle is prepared in the same manner as in Example 1, except that 10 parts by weight of decyltrimethoxysilane is used as the surface treating agent in place of the phenyltrimethoxysilane. Then, an electrophotographic photoreceptor is obtained in the same manner as in Example 1, except that this coated silicon dioxide fine particle is used.

Comparative Example 5

A coated silicon dioxide fine particle is prepared in the same manner as in Example 1, except that 10 parts by weight of methyltrimethoxysilane is used as the surface treating agent in place of the phenyltrimethoxysilane. Then, an electrophotographic photoreceptor is obtained in the same manner as in Example 1, except that this coated silicon dioxide fine particle is used.

Comparative Example 6

A coated silicon dioxide fine particle is prepared in the same manner as in Example 1, except that 10 parts by weight of trimethylmethoxysilane is used as the surface treating agent in place of the phenyltrimethoxysilane. Then, an electrophotographic photoreceptor is obtained in the same manner as in Example 1, except that this coated silicon dioxide fine particle is used.

[Evaluation Test of Electrophotographic Photoreceptor]

Each of the above-prepared electrophotographic photoreceptors is installed in a full color printer Docu Centre Color 1450 drum cartridge, manufactured by Fuji Xerox Co., Ltd. to configure an image forming apparatus. An image forming test (image density: 10%) with 1,000 sheets is carried out under an environment at 20° C. and 40% RH using each of these image forming apparatuses. At that time, durability and image quality (reproducibility of a fine line and reproducibility of a halftone) of the photoreceptor are evaluated as follows. The obtained results are shown in Table 1. An exposure amount during the image forming test is properly regulated depending upon each of the photoreceptors such that a charge potential of a 100% density area of the photoreceptor surface is −300 V±10 V and that a charge potential of a white area thereof is −705 V±10 V <Durability of Photoreceptor>

A thickness of the photoreceptor is measured before and after the foregoing image forming test, and a thickness loss per 10,000 revolutions of the photoreceptor (nm/10,000 revolutions) is calculated. The durability of the photoreceptor is evaluated from this thickness loss according to the following criteria.

The durability is determined on the basis of a wear rate of the photoreceptor of Comparative Example 2 before and after the image following test in the following manner.

"Good": The wear rate is 10% or more as compared with that of Comparative Example 2.

"Slightly good": The wear rate is lower by more than 0% and less than 10% as compared with that of Comparative Example 2.

"Slightly poor": The wear rate is higher by more than 0% and less than 10% as compared with that of Comparative Example 2.

"Poor": The wear rate is higher by 10% or more as compared with that of Comparative Example 2.

The wear rate of the photoreceptor is calculated according to the following expression.

$$\text{Wear rate (\%)}=((A-B)/A)\times 100$$

A: Thickness of the photoreceptor before the image forming test

B: Thickness of the photoreceptor after the image forming test

<Evaluation of Image Quality>

After the foregoing image forming test, image formation is carried out under an environment at a high temperature and a high humidity (28° C., 80% RH), and at that time, the image quality (reproducibility of a 1-dot line obliquely at 45° and reproducibility of 30% halftone) is evaluated according to the following evaluation criteria.

"Good": No problem

"Slightly poor": Thinning of the fine line or slight abnormality of the halftone density is observed (problematic in practical use in a color machine with a severe specification, etc.).

"Poor": Partial disappearance of the fine line or abnormality of the halftone density is observed (problematic in practical use).

<Evaluation of Electric Characteristics>

In addition to the foregoing evaluations, stability of electric characteristics of the photoreceptor is evaluated from an amount of changes in a VL potential difference (VL change amount) before and after the foregoing durability according to the following determination criteria. The evaluation results are shown in Table 1.

"Good": The VL change amount is −19 V or more and less than +20 V (not problematic at all).

"Slight potential increase": The VL change amount is +20 V or more and less than +40 V (not problematic in practical use).

"Potential increase": The VL change amount is +40 V or more (problematic in practical use).

TABLE 1

| | Coated insulating inorganic particle | | | | | |
|---|---|---|---|---|---|---|
| | Insulating inorganic particle | | | Surface treating agent | | |
| No. | Material | Specific surface area value ($m^2/g$) | Average particle size (nm) | —$R^1$ | k | —$R^2$ |
| Example 1 | $SiO_2$ | 50 | 40 | —Ph | 1 | —$CH_3$ |
| Example 2 | $SiO_2$ | 50 | 40 | —$CH_2CH_2Ph$ | 1 | —$CH_3$ |
| Example 3 | $SiO_2$ | 50 | 40 | 1-Naphthyl | 1 | —$CH_3$ |
| Example 4 | $SiO_2$ | 50 | 40 | 4-Pyridylethyl- | 1 | —$CH_2CH_3$ |
| Example 5 | $SiO_2$ | 11.3 | 300 | —Ph | 1 | —$CH_3$ |
| Example 6 | $SiO_2$ | 90 | 20 | —Ph | 1 | —$CH_3$ |
| Example 7 | $SiO_2$ | 150 | 14 | —Ph | 1 | —$CH_3$ |
| Example 8 | $SiO_2$ | 300 | 7 | —Ph | 1 | —$CH_3$ |
| Example 9 | $Al_2O_3$ | 55 | 31 | —Ph | 1 | —$CH_3$ |
| Comparative Example 1 | $SiO_2$ | 50 | 40 | —Ph | 1 | —$CH_3$ |
| Comparative Example 2 | — | — | — | — | — | — |
| Comparative Example 3 | $SiO_2$ (silica gel) | 690 | Not more than 100 | —Ph | 1 | —$CH_3$ |

TABLE 1-continued

| | | | | | | |
|---|---|---|---|---|---|---|
| Comparative Example 4 | $SiO_2$ | 50 | 40 | $—C_{10}H_{21}$ | 1 | $—CH_3$ |
| Comparative Example 5 | $SiO_2$ | 50 | 40 | $—CH_3$ | 1 | $—CH_3$ |
| Comparative Example 6 | $SiO_2$ | 50 | 40 | $—CH_3$ | 3 | $—CH_3$ |

| | Fluorine-containing organic particle | | Printing test | | | |
|---|---|---|---|---|---|---|
| No. | Material | Content relative to the total solids content of charge transporting layer | Durability (film wear after printing with 10,000 sheets) | Fine line density (reproducibility of density of 1-dot line) | Unevenness (uniformity of density on halftone image quality) | Electric characteristics VL |
| Example 1 | PTFE | 8.6% by weight | Good | Good | Good | Good |
| Example 2 | PTFE | 8.6% by weight | Good | Good | Good | Good |
| Example 3 | PTFE | 8.6% by weight | Slightly good | Good | Good | Good |
| Example 4 | PTFE | 8.6% by weight | Slightly good | Good | Good | Good |
| Example 5 | PTFE | 8.6% by weight | Good | Good | Good | Good |
| Example 6 | PTFE | 8.6% by weight | Good | Good | Good | Good |
| Example 7 | PTFE | 8.6% by weight | Good | Good | Good | Good |
| Example 8 | PTFE | 8.6% by weight | Good | Good | Good | Good |
| Example 9 | PTFE | 8.6% by weight | Good | Good | Good | Slight potential increase |
| Comparative Example 1 | — | — | Poor | Good | Good | Good |
| Comparative Example 2 | PTFE | 12.2% by weight | Basis | Poor | Slightly poor | Potential increase |
| Comparative Example 3 | PTFE | 8.6% by weight | Slightly poor | Slightly poor | Slightly poor | Good |
| Comparative Example 4 | PTFE | 8.6% by weight | Poor | Good | Slightly poor | Good |
| Comparative Example 5 | PTFE | 8.6% by weight | Poor | Slightly poor | Slightly poor | Good |
| Comparative Example 6 | PTFE | 8.6% by weight | Poor | Slightly poor | Slightly poor | Good |

Formula of surface treating agent: $(R^1)_k—Si—(OR^2)_{4-k}$

The foregoing description of the exemplary embodiments of the present invention has been provided for the purpose of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. An electrophotographic photoreceptor, comprising:

a conductive support; and a photosensitive layer provided on or above the conductive support, the photosensitive layer including an outermost surface layer at the farthest location from the conductive support, wherein the outermost surface layer contains:

coated insulating inorganic particles obtained by subjecting insulating inorganic particles having a specific surface area of not more than about 300 $m^2/g$ to a coating treatment with an aromatic functional group-containing compound;

fluorine-containing organic particles; and a fluoroalkyl group-containing copolymer containing at least repeating units represented by Formula (I) and Formula (II):

(I)

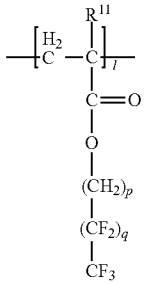

-continued (II)

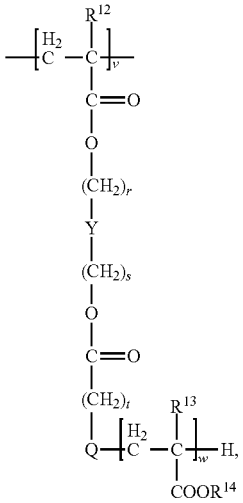

wherein each of l, v, and w represents a positive number of 1 or more;

each of p, r, s, and t represents 0 or a positive number of 1 or more;

q represents a positive number of 1 or more and not more than 7;

each of $R^{11}$, $R^{12}$, $R^{13}$, and $R^{14}$ represents a hydrogen atom or an alkyl group;

Q represents an alkylene chain, a halogen-substituted alkylene chain, —O—, —NH—, or a single bond;

Y represents an alkylene chain, a halogen-substituted alkylene chain, —($C_zH_{2z-1}$(OH))—, or a single bond; and z represents a positive number of 1 or more.

2. The electrophotographic photoreceptor according to claim 1, wherein the insulating inorganic particles are at least one selected from the group consisting of silicon dioxide particles, alumina particles, zirconia particles, and magnesium oxide particles.

3. The electrophotographic photoreceptor according to claim 2, wherein the insulating inorganic particles are at least one selected from the group consisting of silicon dioxide particles and alumina particles.

4. The electrophotographic photoreceptor according to claim 3, wherein the insulating inorganic particles are silicon dioxide particles.

5. The electrophotographic photoreceptor according to claim 1, wherein the insulating inorganic particles have a specific surface area of about 50 $m^2/g$ or more and not more than about 200 $m^2/g$.

6. The electrophotographic photoreceptor according to claim 1, wherein the aromatic functional group-containing compound includes a compound represented by formula (I):

$$(R^1)_k—Si—(OR^2)_{4-k} \quad (1)$$

wherein $R^1$ represents a phenyl group, an ethylphenyl group, a pyridylethyl group, or a naphthyl group;

$R^2$ represents an alkyl group; and k represents an integer of 1 or more and not more than 3.

7. The electrophotographic photoreceptor according to claim 6, wherein in formula (1), $R^2$ is a methyl group or an ethyl group, and k is 1 or 2.

8. The electrophotographic photoreceptor according to claim 1, wherein the fluorine-containing organic particles are at least one selected from the group consisting of a tetrafluoroethylene resin (PTFE), a trifluorochloroethylene resin, a hexafluoropropylene resin, a vinyl fluoride resin, a vinylidene fluoride resin, a difluorodichloroethylene resin, and particles including a copolymer thereof.

9. The electrophotographic photoreceptor according to claim 8, wherein the fluorine-containing organic particles are at least one selected from the group consisting of a tetrafluoroethylene resin (PTFE), a vinylidene fluoride resin, and particles including a copolymer thereof.

10. The electrophotographic photoreceptor according to claim 1, wherein the fluorine-containing organic particles have a particle size of a primary particle of about 0.05 μm or more and not more than about 1 μm.

11. A process cartridge, comprising:

the electrophotographic photoreceptor according to claim 1;

a charging unit that charges the electrophotographic photoreceptor;

a developing unit that develops an electrostatic latent image formed on the electrophotographic photoreceptor with a toner to form a toner image;

a cleaning unit that removes a toner remaining on a surface of the electrophotographic photoreceptor;

an opening for exposure;

an opening for destaticization; and a pair of installing rails.

12. An image forming apparatus, comprising:

the electrophotographic photoreceptor according to claim 1;

a contact charging device for charging the electrophotographic photoreceptor;

a power source connected to the contact charging device;

an exposing unit that exposes the charged electrophotographic photoreceptor to form an electrostatic latent image;

a developing unit that develops the electrostatic latent image with a toner to form a toner image;

a cleaning unit;

a transfer unit that transfers the toner image onto a transfer medium from the electrophotographic photoreceptor;

a fixing device having a pair or rollers; and a destaticizer.

13. The electrophotographic photoreceptor according to claim 1, wherein the weight average molecular weight of the fluoroalkyl group-containing copolymer is from 10,000 to 100,000.

14. The electrophotographic photoreceptor according to claim 1, wherein the weight average molecular weight of the fluoroalkyl group-containing copolymer is from 30,000 to 100,000.

* * * * *